US006962342B2

(12) United States Patent
Wieghardt

(10) Patent No.: US 6,962,342 B2
(45) Date of Patent: Nov. 8, 2005

(54) SYSTEM FOR SEALING OFF A GAP

(75) Inventor: Kai Wieghardt, Bochum (DE)

(73) Assignee: Siemens Aktiengesellschaft, Munich (DE)

( * ) Notice: Subject to any disclaimer, the term of this patent is extended or adjusted under 35 U.S.C. 154(b) by 101 days.

(21) Appl. No.: 10/275,178

(22) PCT Filed: Apr. 23, 2001

(86) PCT No.: PCT/EP01/04576

§ 371 (c)(1),
(2), (4) Date: Nov. 4, 2002

(87) PCT Pub. No.: WO01/83951

PCT Pub. Date: Nov. 8, 2001

(65) Prior Publication Data

US 2003/0107181 A1 Jun. 12, 2003

(30) Foreign Application Priority Data

May 4, 2000 (EP) ..... 00109543

(51) Int. Cl.[7] ..... F16J 15/447

(52) U.S. Cl. ..... 277/415; 277/277; 277/411; 277/413; 277/414

(58) Field of Search ..... 277/409, 411, 277/412, 413, 414, 415

(56) References Cited

U.S. PATENT DOCUMENTS

| | | | | | |
|---|---|---|---|---|---|
| 3,547,455 | A | | 12/1970 | Daunt | |
| 3,701,536 | A | | 10/1972 | Matthews | |
| 4,023,252 | A | * | 5/1977 | Levinstein et al. | 428/650 |
| 4,139,376 | A | | 2/1979 | Erickson | |
| 4,177,004 | A | | 12/1979 | Riedmiller | |
| 4,257,735 | A | | 3/1981 | Bradley | |
| 5,143,383 | A | * | 9/1992 | Glynn et al. | 277/412 |
| 5,326,647 | A | | 7/1994 | Merz | |
| 5,704,614 | A | * | 1/1998 | Sanders et al. | 277/303 |
| 6,116,612 | A | * | 9/2000 | Halliwell et al. | 277/412 |
| 6,352,264 | B1 | * | 3/2002 | Dalzell et al. | 277/415 |
| 6,365,274 | B1 | * | 4/2002 | Scheckenbach et al. | 428/402 |

* cited by examiner

*Primary Examiner*—Enoch Peavey
(74) *Attorney, Agent, or Firm*—Harness, Dickey & Pierce, P.L.C.

(57) ABSTRACT

In fluid machines frequently gaps between movable and stationary structural parts have been sealed off. Frequently so-called labyrinth packings are used, whereby sealing strips brush against the opposite structural part. To this end, a brush layer is configured as a porous coating that can be detached from the opposite structural part. The inventive system can be advantageously used in virtually any fluid machines.

19 Claims, 3 Drawing Sheets

SYSTEM FOR SEALING OFF A GAP

This application is the national phase under 35 U.S.C. § 371 of PCT International Application No. PCT/EP01/04576 which has an International filing date of Apr. 23, 2001, which designated the United States of America and which claims priority on European Patent Application number 001 09 543.9 filed May 4, 2000, the entire contents of which are hereby incorporated herein by reference.

FIELD OF THE INVENTION

The present invention generally relates to an arrangement for a fluid-flow machine. In particular, the present invention generally relates to a steam turbine, for sealing a gap between a movable component and a stationary component, of which one carries a grazing layer on a surface flanking the gap.

BACKGROUND OF THE INVENTION

In machines for treating and processing flowing, liquid and/or gaseous media, gaps between movable and stationary components are often to be sealed off from the flowing medium. This also applies in particular to turbines to which steam is admitted, in which a gap is sealed off between a rotor and a casing surrounding the latter in order to block the path of the steam past blade rings. The quality of these seals has a considerable effect on the efficiency of these machines, thus in particular also in the case of steam turbines.

Sealing strips arranged axially one behind the other—also called labyrinth seals—are normally used for this purpose in steam turbine construction. These seals are characterized by sealing strips which are arranged transversely to the flow and which virtually completely close a gap which is usually several millimeters wide. In this case, it is accepted that the sealing strips sometimes graze the component opposite them during transient processes and become slightly worn themselves at the same time. Such labyrinth seals are used in turbine construction both at blading and as piston and shaft seals.

A special form of these seals which has the same effect is a honeycomb seal. This seal, on one side of the gap, usually on the side fixed to the casing, has a structure which reproduces a honeycomb and on whose open surface a leakage flow is prevented by a multiplicity of small vortices in chambers formed by the honeycomb structure. A flow resistance produced as a result prevents a free flow in the passage defined by the honeycomb-like structure on one side.

U.S. Pat. No. 4,177,004 discloses a turbine in which a gap between a turbine blade and a ring enclosing the latter in the circumferential direction and suspended in a casing is to be sealed off. This arrangement is designed in such a way that the turbine blade itself occasionally grazes the ring enclosing it. In order to avoid impending damage in this case, the ring is coated with a material which causes no wear on the turbine blade.

However, both in the known labyrinth seals and in the arrangement according to U.S. Pat. No. 4,177,004, contact between the surfaces of the components moving along one another occurs only very rarely. This is because the components involved are at such a large distance from one another that contact actually takes place only occasionally during extremely transient states. On the other hand, the result of this is that—apart from the rare moments of the contact between the components—there is a gap through which a proportion of a working medium, which proportion is not to be disregarded, flows past the turbine blade without being utilized.

SUMMARY OF THE INVENTION

An object of an embodiment of the present invention is to reduce the quantity of working medium flowing past the turbine blade without being utilized for example steam—without the need for special apparatus and without impairing the operating reliability.

An object of an embodiment of the present invention is achieved according to the present invention in that a component flanking a gap to be scaled, in the region of the gap, carries a grazing layer which is designed as a porous coating which can be at least partly abraded from the component opposite it. By the use of a porous grazing layer in combination with sealing strips opposite it, the favorable properties of a labyrinth seal and of a honeycomb seal are combined with one another. Due to the penetration of the scaling strips, which is possible without risk, into the coating opposite it, the effectiveness of the sealing arrangement is substantially enhanced. As a result, a marked improvement in the sealing capacity is achieved in a surprisingly simple and efficient manner.

A further advantage of an embodiment of the present invention relates to thermoshock resistance. The thermoshock resistance is increased by the porosity and which, with increasing proportion of cavities, is in addition accompanied by increasing flexibility of the coating.

In an embodiment of the present invention, the surface opposite the coating has at least one sealing lip, which is arranged parallel to the direction of movement of the movable component. The at least one sealing lip closes the gap, projects like a cutting edge and includes a sealing strip which penetrates slightly into the coating during movement of the component and partly abrades the coating in the process. The thickness of the coating is equal to 0.5 to 0.1 times the width of the gap flanked by it.

According to an embodiment of the present invention, the coating is applied by spraying together with a bonding agent and is made of a foamed, preferably metallic, material. As one alternative to this, the coating contains a mixture of a mineral and a metallic component and/or a gasifiable or vaporizable component. According to another composition of the coating, it contains granular material proportions, after the at least partial removal of which from the coating the latter has recesses on its surface.

Irrespective of its respective specific embodiment, the coating may be arranged on the stationary component flanking the gap. It is sometimes also expedient to fit both sides of the gap with sealing strips and to provide both sides of the gap—that is both that of the stationary component and that of the moving component—with a coating and with sealing lips.

An additional manner of realizing an embodiment of the present invention includes configuring these surfaces in a steplike manner in the radial direction on one side or on both sides on surfaces flanking the gap.

To avoid damage when the sealing strips are penetrating into the coating opposite them in each case, the sealing strips may be narrowed at their free ends. One example is narrowing the sealing strips at their free ends down to 0.2 to 0.5 mm.

The combination of features according to an embodiment of the present invention can advantageously be used without restriction, optimum gap sealing being achieved while operating reliability is ensured at the same time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Parts corresponding to one another are provided with the same designations in all the figures.

Figure 1:
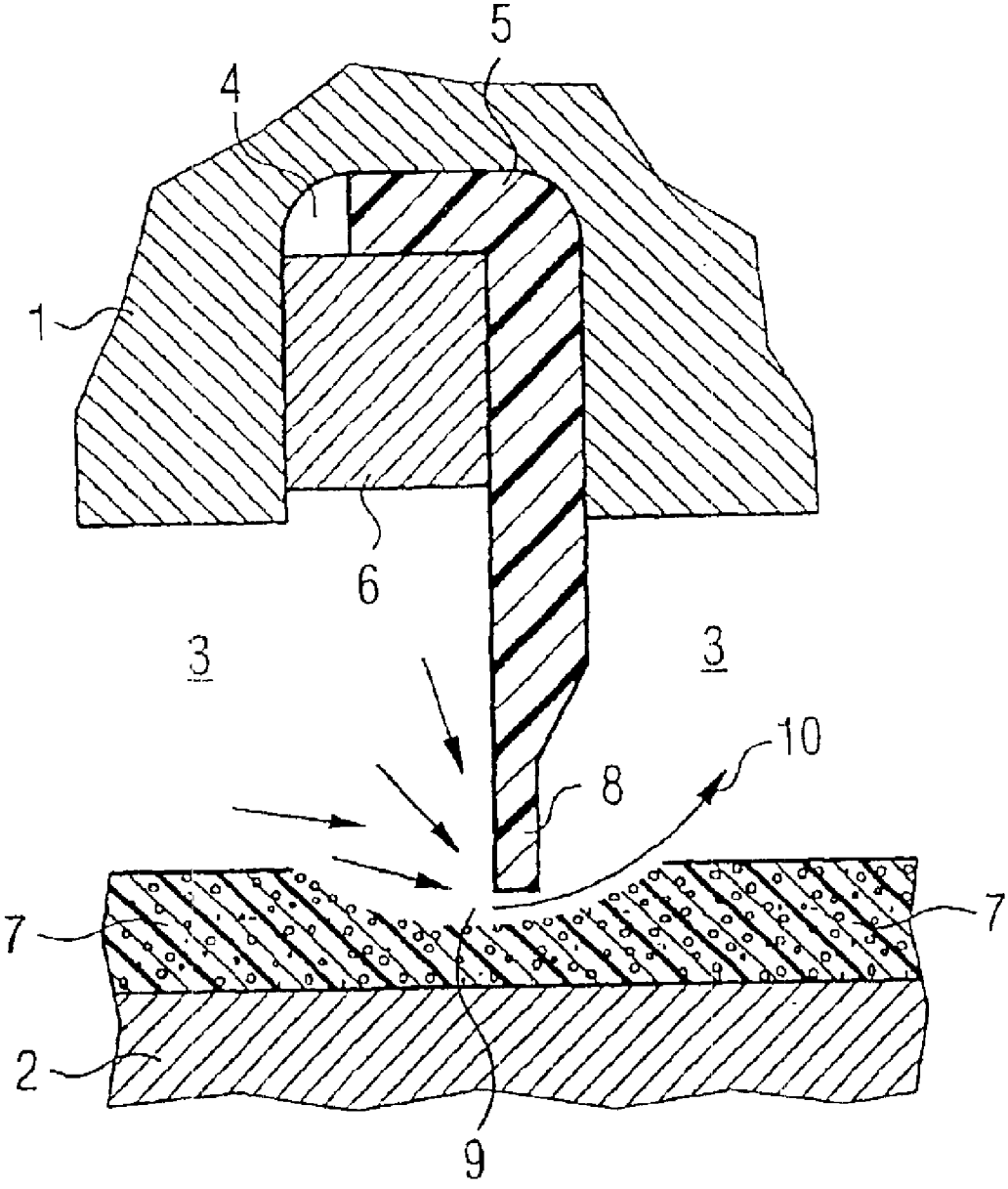
FIG. 1 illustrates a sectional representation on an enlarged scale through a sealing strip in engagement with a layer according to an embodiment of the present invention.

In FIG. 1, two components 1 and 2 of a steam turbine (not shown in any more detail) form a gap 3 up to several millimeters wide, which is sealed off from a steam flow. The component 1 is preferably a rotor part movable in the operating state and has a groove 4 for accommodating a sealing strip 5 serving as sealing lip. The sealing strip 5 is L-shaped in cross section and rests with its leg, which is shorter in cross section, on the base of the groove 4. The sealing strip 5 includes one or more sections complementing one another in the circumferential direction to form a ring and is secured in the groove 4 by a calking wire 6.

The component 2 opposite the component 1 on the other side of the gap 3 is preferably stationary in the operating state and has a coating designed as a grazing layer 7. The coating may have a thickness corresponding to 0.5 to 0.1 times the width of the gap 3 and is made of a porous or foamy material, for example a foamed metal or a mixture of a mineral and a metallic component and/or contains a gasifiable or vaporizable component.

According to a further possible embodiment of the present invention, the coating may include a mixture which contains a granular component which can be removed from the surface of the coating, so that its surface is then formed by a multiplicity of recesses adjoining one another.

All of these embodiments for the coating may be expediently applied together with a bonding agent to the component 1 and/or 2 carrying them, the most expedient method often being to spray the coating on.

A leg 8, facing the coating, of the scaling strip 5 of L-shaped cross section grazes the coating and is narrowed at its end plunging slightly into the coating. As a result, the energy demand during grazing or penetration of the sealing strip 5 into the coating is restricted to a very low value. In its narrowed region, the thickness of the scaling strip 5 is about 0.2 mm and is approximately of the order of magnitude of the width of a passage 9 which is formed between the sealing strip 5 and the grazing layer 7 represented by the coating and through which a leakage flow 10 of steam flows.

In this case, the flow resistance for the leakage flow 10 in the passage 9 is not simply determined only by its length and its cross section, but is significantly increased by the unevenness in the surface of the coating. This is achieved by virtue of the fact that, even inside the short passage 9 and despite its comparatively narrow cross section, a multiplicity of small and very small vortices are forced inside the leakage flow in this region. This is a result in particular of an embodiment according to the present invention of the coating applied as grazing layer 7.

At larger pressure differences between the start and the end of the gap 3, a multiplicity of sealing strips 5 and thus passages 9 are connected one behind the other in this gap 3, so that a sufficiently small and reliably controllable pressure drop is allotted to each of the individual passages 9. Some exemplary embodiments for this are shown in FIGS. 2 to 6.

Figure 2:
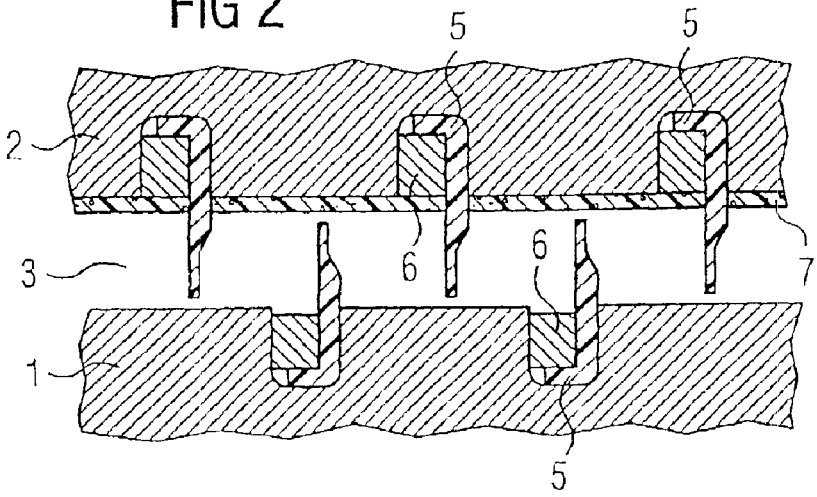
FIGS. 2, 3 and 4 illustrate an arrangement of an embodiment of the present invention with a gap between a casing and a shaft.
Figure 3:
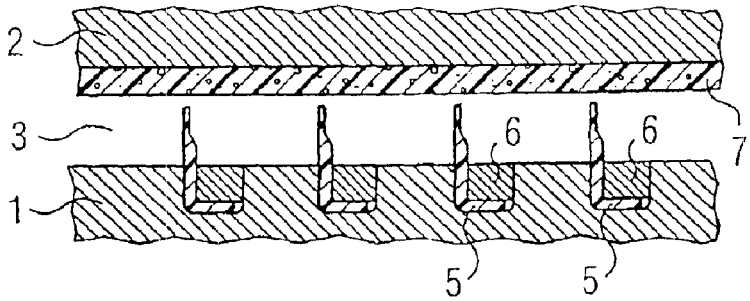
Figure 4:
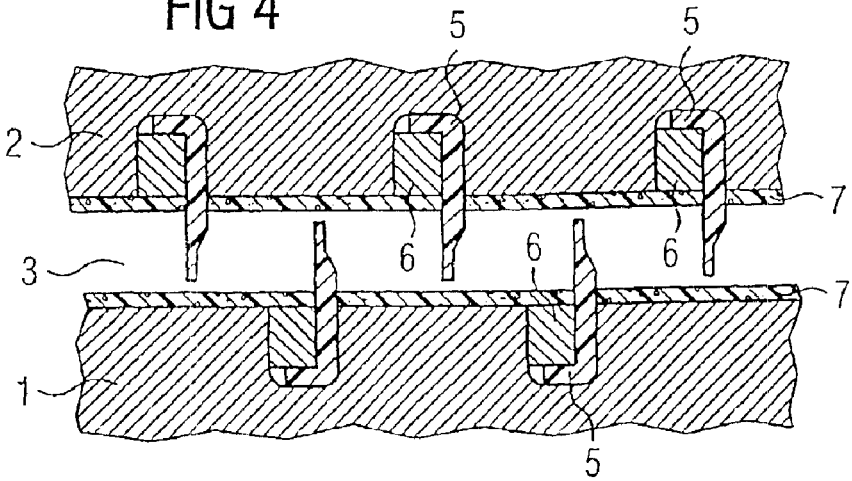

FIGS. 2 to 4 show various solutions for the sealing of the gap 3 between the stationary component 2 of a turbine casing (not shown in any more detail) and a turbine shaft as rotating, thus moving, component 1. Here, in these three examples, the casing-side, stationary component 2 is provided with a coating as grazing layer 7. In the example according to FIG. 4, the moving surface of the shaft, as moving component 1, also carries a coating.

In the solution according to FIG. 3, sealing strips 5 are anchored solely in the shaft, as the moving component 1, these sealing strips 5 penetrating slightly into the opposite grazing layer 7. Since the passages 9 formed between the sealing strips 5 and the grazing layer 7 lie one behind the other on a straight line in this embodiment, this arrangement is also designated as a see-through seal.

The arrangements according to FIGS. 2 and 4 have sealing strips 5 in both the component 1 and the component 2, each of these sealing strips 5 extending in the gap 3 between the two adjacent components 1, 2 in the direction of the respectively opposite component 1 or 2. However, since only the component 2 is provided with a grazing layer 7 in the solution in accordance with FIG. 2, the effect according to an embodiment of the present invention is only achieved for the sealing strips 5 in the opposite component 1. On the other hand, in the solution in accordance with FIG. 4, each of the sealing strips on both sides of the gap 3 interacts with a porous coating as grazing layer 7.

Figure 5:
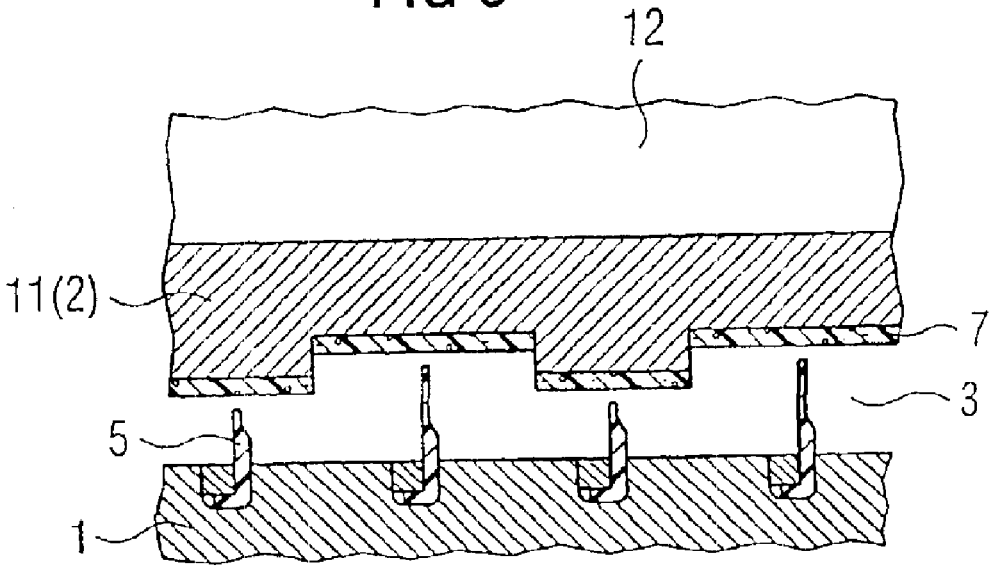
FIG. 5 illustrates an arrangement of an embodiment of the present invention with a gap between a guide blade ring and a shaft.

FIG. 5 shows a seal between a turbine shaft as moving part 1 and a shroud band 11, the shroud band 11 supporting ends of guide blades 12. In this case, that side of the shroud band 11 which faces the gap 3 is designed to be stepped and carries a coating as grazing layer 7 on its sectional surfaces oriented parallel to the axis. At least one sealing strip 5 is opposite each step of the shroud band 11. The shroud band 11 is composed of segments which together produce a complete ring in the circumferential direction of the turbine shaft.

Figure 6:
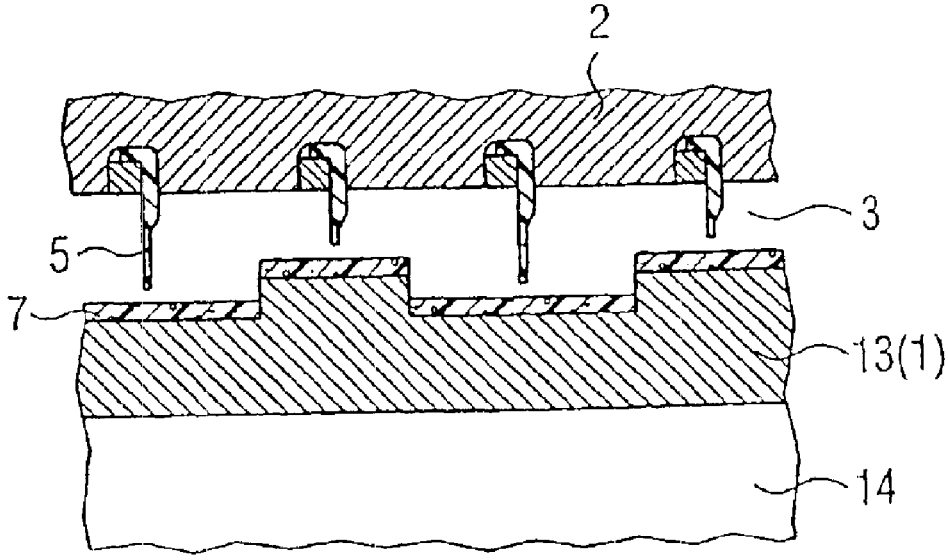
FIG. 6 illustrates an arrangement of an embodiment of the present invention with a gap between a casing and a moving blade ring.

FIG. 6 shows a seal between a casing part as stationary component 2 and a shroud band 13 which supports the ends of moving blades 14 against one another. That side of the shroud band 13 which faces the component 2 is designed to be stepped and each of the axially parallel step surfaces is provided with a coating as grazing layer 7. A sealing strip 5 is again opposite each strip, formed as a result, of the grazing layer 7. The shroud band 13 is also composed of segments which complement one another to form a complete ring.

All the grazing layers 7 interact with their opposite sealing strips 5 in the manner described for FIG. 1.

Although coatings configured according to the invention and used as grazing layer 7 especially suitable for use in steam turbines, they may also be advantageously used in the same way in all other fluid-flow machines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arrangement for a fluid-flow machine, the arrangement for sealing a gap between a movable component and a stationary component, wherein the movable component and the stationary component have respective surfaces flanking the gap, each of the surfaces flanking the gap carrying, a grazing layer that is a porous coating which can be abraded from one of the movable component and the stationary component being opposite thereto, and at least one sealing strip.

2. The arrangement as claimed in claim 1, wherein the sealing strip of one flanking surface is opposite to the coating of the other flanking surface, the sealing strips are arranged parallel to a direction of movement of the movable component, close the gap, penetrate into the coating during movement of the component and partly abrade the coating.

3. The arrangement as claimed in claim 1, wherein the thickness of each coating is equal to 0.5 to 0.1 times the width of the gap.

4. The arrangement as claimed in claim 1, wherein each coating is applied together with a bonding agent.

5. The arrangement as claimed in claim 1, wherein each coating is sprayed on.

6. The arrangement as claimed in claim 1, wherein each coating is made of a foamed material.

7. The arrangement as claimed in claim 1, wherein each coating contains a mixture of mineral and metallic components.

8. The arrangement as claimed in claim 1, wherein each coating contains a gasifiable or vaporizable component.

9. The arrangement as claimed in claim 1, wherein each coating contains a granular component, after the at least partial removal of which the coating has recesses on its surface.

10. The arrangement as claimed in claim 1, wherein at least one coating is carried by a surface of the stationary component, wherein the stationary component flanks the gap.

11. The arrangement as claimed in claim 1, wherein a surface serving as a base for at least one coating includes sectional surfaces offset from one another by steps.

12. The arrangement as claimed in claim 1, wherein the sealing strips are narrowed at their ends interacting with the coating.

13. The arrangement as claimed in claim 1, wherein the fluid-flow machine is a steam turbine.

14. The arrangement as claimed in claim 2, wherein the thickness of each coating is equal to 0.5 to 0.1 times the width of the gap.

15. The arrangement as claimed in claim 1, wherein each coating is made of a foamed metallic material.

16. The arrangement as claimed in claim 1, wherein the sealing strips are narrowed at their ends interacting with the coating down to 0.2 to 0.5 mm.

17. The arrangement as claimed in claim 11, wherein the sealing strips are narrowed at their ends interacting with the coating.

18. The arrangement as claimed in claim 11, wherein the sealing strips are narrowed at their ends interacting with the coating down to 0.2 to 0.5 mm.

19. An arrangement for a fluid-flow machine, comprising:

two components, one of the two components being movable and the other of the components being stationary;

a grazing layer carried by the stationary component;

a grazing layer carried by the movable component;

a sealing strip carried by the stationary component; and a sealing strip carried by the movable component;

wherein the grazing layer of one of the two components is abradeable by way of the sealing strip of the other of the two components.

* * * * *